US005172450A

United States Patent [19]

Cole et al.

[11] Patent Number: 5,172,450

[45] Date of Patent: Dec. 22, 1992

[54] SHAFT CLEANING AND DECONTAMINATION APPARATUS

[75] Inventors: Jack H. Cole, Ponca City, Okla.; C. Michael Swindoll, Pleasanton, Calif.; Mark P. DiStefano, Ponca City, Okla.

[73] Assignee: Conoco Inc., Ponca City, Okla.

[21] Appl. No.: 591,347

[22] Filed: Oct. 1, 1990

[51] Int. Cl.[5] ..... B08B 7/04

[52] U.S. Cl. ..... 15/302; 15/309

[58] Field of Search ..... 15/302, 309.1, 308

[56] References Cited

U.S. PATENT DOCUMENTS

| | | | |
|---|---|---|---|
| 1,575,526 | 3/1926 | Bocher | 15/302 X P |
| 3,044,098 | 7/1962 | Stalson | 15/302 |
| 3,530,526 | 9/1970 | Schmidt | 15/302 |
| 4,391,016 | 7/1983 | Kawamura et al. | 15/302 |
| 4,591,390 | 5/1986 | Scott et al. | 15/302 X |
| 4,734,950 | 4/1988 | Schenke et al. | 15/104.04 X |

*Primary Examiner*—Chris K. Moore

*Attorney, Agent, or Firm*—David W. Westphal

[57] ABSTRACT

This invention relates to a device for cleaning and decontaminating rods, shafts or other long tubular materials. In particular, the device cleans and decontaminates rods that are used in downhole remediation tasks that might otherwise transfer contaminants out of the ground. The device scrubs, washes, rinses and dries the outer surface of the rod while recovering the wash and rinse fluids and any soil or other debris scrubbed from the surface of the rods. In one variation, the rinse fluid is recycled for use as wash fluid to conserve fluids used in the field.

16 Claims, 5 Drawing Sheets

SHAFT CLEANING AND DECONTAMINATION APPARATUS

FIELD OF THE INVENTION

This invention relates to a method and apparatus for cleaning the exterior surfaces of cylindrical shaped objects and more particularly to cleaning the exterior surfaces of long cylindrical rods.

BACKGROUND OF THE INVENTION

In the event that it is believed that potentially hazardous chemicals are present in the ground, an important part of the remediation task is to determine the extent of the contamination. Preferably, a thorough mapping and subsurface analyses should be conducted to assess the hazards and the possible solutions. For example, cone penetrometer systems are known for performing subsurface analyses and are able to provide valuable information about the subsurface materials and conditions.

The cone penetrometer is typically a self-contained system carried by a truck which can be moved into an area and begin the process of acquiring data. The system basically comprises powerful hydraulic rams for driving an assembled rod string, having sensors at the tip and along the string, down into the earth at a controlled speed to a depth of 100 feet or more. Clearly, the nature of such environmental investigations inherently involves the likelihood of contaminating the rod string. Thus, when the rod string is withdrawn from the ground, the operator is likely to be exposed to the hazardous chemical while disassembling the string.

The current procedure for decontaminating the rod string is to spray hot water with a jet spray to wash off the contamination. However, this is not satisfactory since the hazardous materials are then deposited on the ground. Moreover, the jet spray tends to use a lot of water and be rather wasteful. Accordingly, the self-contained truck must reserve substantial space and weight carrying ability for the water and this is not a satisfactory arrangement.

U.S. Pat. No. 4,503,577 to Fowler describes a decontamination apparatus for removing radioactive particles from long cylindrical pipes. The pipes are pulled horizontally through a sealed housing and the radioactive particles are removed by liquid freon sprayed onto the peripheral surfaces of the pipes. The operation of the apparatus, however, requires substantial handling of the pipes by operating personnel. As such, the use of the apparatus includes costs for safety suits and exposure prevention gear as well as the increased risks of contaminating the operating personnel during handling. In addition, the apparatus is limited to decontaminating rods in substantially the horizontal plane since it is likely that liquid freon will leak through the seals if the apparatus were tilted at an angle.

Other arrangements are known for generally cleaning the exterior surfaces of pipes and rods. For example, U.S. Pat. No. 4,570,285 to Skelton discloses a device for removing rust and debris from wire ropes with wire brushes. The device even includes followers to guide the brushes into the recesses of the ropes. However, the device is not suitable for decontaminating the rope or any other generally cylindrical article. The brushes are more likely to spread the contamination around rather then remove it.

Similarly, U.S. Pat. No. 2,631,315 to Hauser discloses a pipe cleaning machine which is designed to remove heavy tar-like protective coatings or rust buildups from the exterior surfaces of pipes. However, simply scouring the surface with an abrasive does not render the pipe decontaminated.

There are a number of other devices, such as disclosed in U.S. Pat. Nos. 2,937,894 to Martin et al., 3,475,781, to Grant and 4,279,300 to Wirsch, relate to devices which encircle rods or pipes for spraying or treating the exterior surfaces thereof. However, these references are not pertinent to cleaning a contaminated pipe and are, therefore, not discussed in detail.

Accordingly, it is an object of the present invention to provide a method and apparatus which overcomes the drawbacks and disadvantages of the prior art as discussed above.

It is also an object of the present invention to provide a method and apparatus for decontaminating shafts of indeterminate length.

It is a more particular object to provide a method and apparatus for decontaminating shafts in an environmentally sound and responsible manner.

It is also an object of the present invention to clean and decontaminate rod strings as they are withdrawn from the ground prior to being handled by operating personnel.

It is a further object of the present invention to provide a method and apparatus for cleaning and decontaminating rod strings used in environmentally hazardous situations where the string is likely to become contaminated.

SUMMARY OF THE INVENTION

The above and other objects of the present invention have been achieved by an apparatus which includes a housing having a hollow interior space and openings at the end thereof. The hollow interior space includes a cleaning chamber therein where cleaning fluid is provided on the surface of the shaft and the surface is scrubbed to remove debris. The apparatus also collects the cleaning fluid from the peripheral surfaces of the shaft.

BRIEF DESCRIPTION OF THE DRAWINGS

Some of the objects have been stated and other objects will appear as the description proceeds when taken in conjunction with the accompanying drawings, in which—

FIG. 6 is a cross sectional view of an alterative embodiment of the present invention similar to FIG. 2 illustrating.

DETAILED DESCRIPTION OF THE PREFERRED EMBODIMENT

Figure 1:
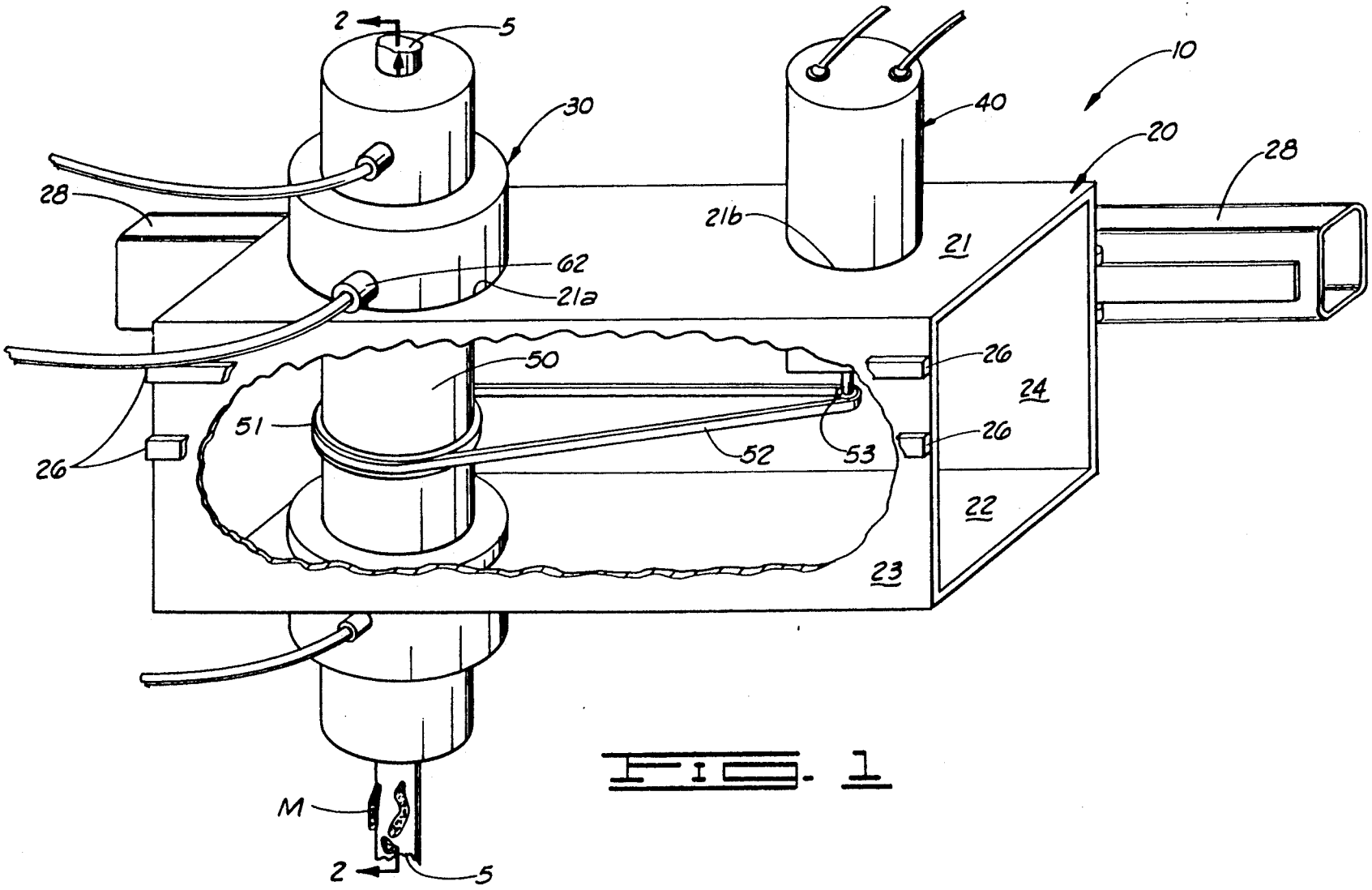
FIG. 1 is a partially fragmentary perspective view of a shaft cleaning and decontamination apparatus which forms the preferred embodiment of the present invention.

Turning now to the drawings, there is illustrated in FIG. 1, a preferred embodiment of a shaft cleaning and decontamination apparatus generally indicated by the numeral 10. The apparatus 10 comprises a frame 20 which has a generally rectangular cross section and a length of approximately twice its width. The frame 20 is preferably formed of a unitary piece of rigid material such as steel aluminum or the like in the shape of an open ended rectangular tube. The frame 20 includes top and bottom walls 21 and 22, respectively, and side walls 23 and 24. The side wall 23 has been broken away for clarity.

The frame 20 supports the working parts of the apparatus 10 and provides a secure means for attaching the apparatus 10 to other equipment for use or storage. The frame 20 includes slide rails 26 which are adapted to slide over mounting rails 28 (only one of which is shown) to mount the apparatus 10. In the preferred embodiment, the mounting rails 28 are disposed transversely under a self-contained cone penetrometer environmental assessment truck such as discussed above in the Background of the Invention. Accordingly, the apparatus 10 may slide into a position below the hydraulic rams in the path of the rod string as the rod string is pushed into and withdrawn from the ground. A suitable clamping arrangement may be used to secure the apparatus 10 to the mounting rails 28 to prevent the apparatus 10 from sliding excessively along the rails during operation of the cone penetrometer system or transportation of the truck.

The frame 20 includes generally aligned circular openings 21*a* and 22*a* (FIG. 2) in its top and bottom walls 21 and 22 for mounting a cylindrical housing generally indicated by the numeral 30. The frame 20 also includes a second opening 21*b* in the top wall 21 for mounting a motor 40 which will be explained in more detail later. Focusing on the generally cylindrical housing 20, which is illustrated in more detail in FIG. 2, the path of the rod string or shaft extends substantially coaxially through the generally cylindrical housing 30 and, accordingly, the generally cylindrical housing 30 is illustrated with a portion of a shaft, indicated by the letter S, extending therethrough.

Figure 2:
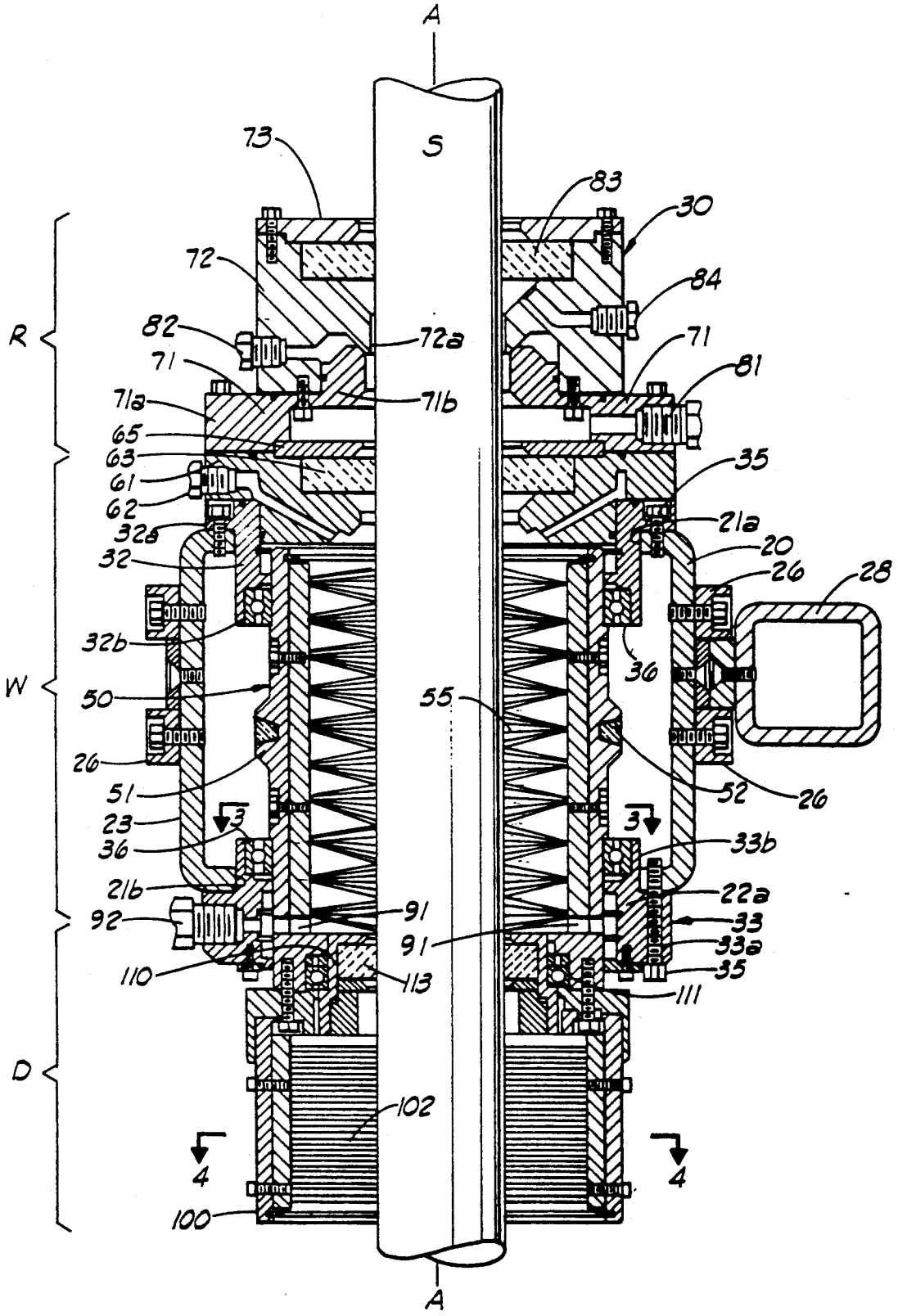
FIG. 2 is cross sectional view of the shaft cleaning and decontamination apparatus taken along the line 2—2 in FIG. 1.

Referring now to FIG. 2, the generally cylindrical housing 30 comprises an upper main sleeve 32 attached to the frame 20 at the circular opening 21*a* by suitable means such as bolts 35. The upper main sleeve 32 includes a radially outwardly extending collar portion 32*a* overlying the upper surface of the top wall 21 and a smaller diameter portion 32*b* extending through the opening 21*a* and into the interior of the frame 20. Similarly, the lower main sleeve 33 is attached at the circular opening 21*b* by bolts 35 and the lower main sleeve 33 includes a radially outwardly extending collar portion 33*a* overlying the lower surface of the bottom wall 22 and a smaller diameter portion 33*b* extending through the circular opening 22*a* and into the interior of the frame 20. The upper and lower main sleeves 32 and 33 are arranged generally coaxially and are provided with bearings 36 to carry a rotatable barrel 50.

The rotatable barrel 50 is preferably a generally cylindrical tube formed of stainless steel, aluminum or the like. The barrel 50 has an outer diameter slightly smaller than the internal diameter of each of the main sleeves 32 and 33 and has a length of approximately the same dimension of the frame 20 so that the end portions of the barrel 50 are encompassed by each of the main sleeves 32 and 33. As can easily be seen in the drawing, the upper and lower main sleeves 32 and 33 are spaced apart to leave the medial portion of the barrel 50 exposed. The peripheral surface of the barrel 50 is provided with a raised channel extending around the periphery to form a driven pulley 51 which receives a drive belt 52. Referring back to FIG. 1, a motor 40 is mounted to the frame 20 at the opening 21*b* with its drive shaft arranged parallel to the barrel 50. The drive shaft includes a pulley 53 connected at its lower end so as to be substantially in the same plane as the driven pulley 51 and to carry the other end of the drive belt 52. Suitable means may be provided to remove slack from the belt and avoid slippage between the belt and either of the pulleys 51 or 52. By rotation of the motor 40, the barrel rotates in the bearings 36 at speeds preferably above 300 rpm.

Figure 3:
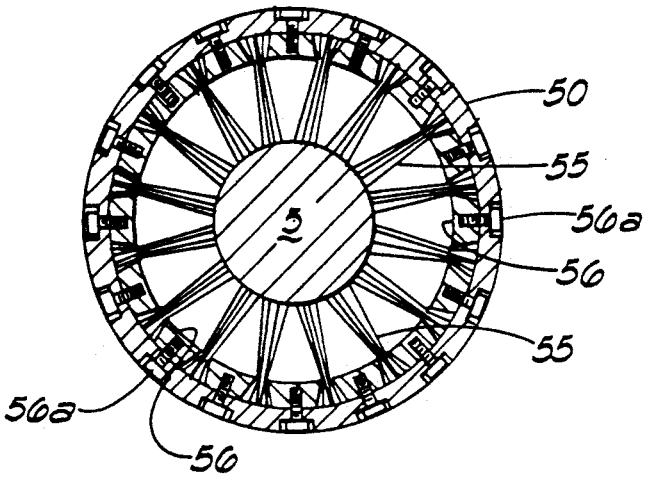
FIG. 3 is a cross sectional view of the shaft cleaning and decontamination apparatus taken along line 3—3 in FIG. 2.

The inner diameter of the rotatable barrel 50 is substantially larger the outer diameter of the shaft S. Referring now to FIGS. 2 and 3, the barrel 50 includes a series of brushes 55 directed radially inwardly to scrub the exterior surface of the shaft S. The brushes 55 are preferably made of nylon and mounted in vertical segments along the interior of the barrel 50. The brush segments are pinched between stainless steel or aluminum strips 56 which are secured to the interior of the barrel 50 by suitable means such as bolts 56*a*. The brushes 55 scrub the surface of the shaft S as the motor 40 rotates the barrel 50 to remove contamination from the shaft S. The portion of the barrel 50 which includes the brushes 55 partially defines a washing chamber which will be more fully defined and explained below. In the preferred embodiment, the washing chamber which is generally indicated by the letter W is the second of three stages of the cleaning and decontamination apparatus.

Referring again to FIG. 2, the housing 30 further includes a washing chamber annular cap 61. The washing chamber annular cap 61 is bolted directly to the upper main sleeve 32 and includes a cleaning fluid inlet port 62. The cleaning fluid inlet port 62 delivers cleaning fluid to an annular space which carries the cleaning fluid to a network of radially inwardly directed passages for delivering the cleaning fluid into the interior of the barrel 50, or more particularly, to the exterior of the shaft S. The annular space in the annular cap 61 serves to distribute the cleaning fluid to all sides of the shaft S.

The washing chamber annular cap 61 is also arranged to carry an elastomer seal 63 which is sized to have an inner diameter of substantially the same size, or perhaps slightly smaller, as the outer diameter of the shaft S. Therefore, the seal is provided in sealing contact with the shaft S passing through the apparatus 10. An annular member 65 is arranged to secure the elastomer seal 63 to the washing chamber annular cap 61 so that the elastomer seal 63 does not slide upwardly with the shaft S. The elastomer seal defines the upper portion of the washing chamber W.

The housing 20 further includes a rinsing chamber generally indicated by the letter R wherein the shaft S is rinsed after the shaft S has been washed in the washing chamber W. The rinsing chamber R is actually formed of several axially spaced annular voids which communicate with one another to rinse and dry the shaft S as will be explained below. The rinsing chamber R is formed by several rinse chamber annular members 71, 72 and 73 which are stacked together and mounted to the Washing chamber annular cap 61.

The first rinse chamber annular member 71 has a rather complex shape. It is best described as having a flat disk shaped main portion having a relative large diameter ring portion 71*a* descending from the bottom of the main portion and a relatively small diameter ring portion 71*b* ascending from the top of the main portion. The large diameter descending portion 71*a* provides a short annular space around the shaft S just above the elastomer seal 63. The first rinse chamber annular member 71 is provided with a suction port 81 for a vacuum line to withdraw fluid and air from the housing 20. The upper surface of the ascending portion ring portion 71*b* has inner and outer annular chamfers for reasons that will be described below.

The second rinse chamber annular member 72 is attached to the first member 71 and includes a downwardly extending collar portion which overlies the ascending ring portion 71*b* of the first member 71 to nest therewith. A careful study of the drawing may be necessary for a complete understanding of the second member 72. As noted above, the second member 72 has a downwardly extending collar portion. The bottom surface of the collar portion is in flush contact with the first member 71. The inside diameter of the collar portion is in flush contact with the outer diameter of the ascending ring portion 71*b* of the first member 71. Above the upper surface of the ascending ring portion 71*b* of the first member 71, the second member 72 includes a reduced diameter portion which is spaced from the outer chamfer of the ascending portion 71*b* of the first member 71 but is in very close proximity to the inner chamfer thereof. As such, the first and second members 71 and 72 define, between them, an annular void and a continuous slit nozzle 72*a* surrounding the shaft S. The second member 72 includes a rinsing fluid inlet port 82 for receiving rinsing fluid and directing the fluid in a continuous curtain at the exterior surface of the shaft S to remove wash fluid and any residual contamination. The continuous slit has a downward angle so as to direct the rinsing fluid toward the annular void above the elastomer seal 63. Also, the inner radial dimension of the ascending ring portion 71*b* below the continuous slit nozzle 72*a* is larger than the inner diameter of the second member 72 which is above the slit nozzle 72*a*. Therefore, the preferred path for the fluid is downwardly, opposite to the direction of movement of the shaft S during cleaning and decontamination thereof.

The second member 72 further defines a second vacuum annular void in the rinse chamber R above the continuous slit nozzle 72*a* to remove substantially all remaining liquid on the surface of the shaft S. In particular the reduced diameter portion of the second member 72 has an upper surface which slopes upwardly up to a shoulder. The shoulder receives an elastomer seal 83 similar to the elastomer seal 63 for sealing the top of the housing 30 to the shaft S. Accordingly, the sloping portion of the second member 72 is spaced from the elastomer seal 83 to form the second annular vacuum void around the shaft S. The second member 72 further includes a vacuum port 84 for drawing a vacuum in the second annular vacuum void at the upper portion of the rinsing chamber R. This provides for vacuuming fluid out of the rinsing chamber R that has been squeegeed off the shaft S by the elastomer seal 83.

Accordingly, the rinsing chamber R is defined as being generally between the elastomer seals 63 and 83 and is preferably a closed and sealed chamber by means of suitable sealing means as is known in the seal art.

Focusing at the bottom end of the housing 30, as illustrated in FIG. 1, the apparatus 10 further includes a second barrel 100 attached below and coaxially with the first described barrel 50. Accordingly, the second barrel 100 rotates in conjunction with the first barrel 50, however, the second barrel 100 provides an initial removal of bulk material such as mud, sand and other debris adhering to the surface of the shaft S as it is withdrawn from the ground. By first performing the initial bulk cleaning of the shaft, the washing stage W is able to more fully decontaminate the shaft S without the burden of having to clean large pieces of debris. However, the washing chamber W needs to be sealed at the bottom end so as not to deposit cleaning fluid on the ground. Accordingly, the first barrel 50 carries a generally non-rotating seal support member 110 by a bearing 111. The bearing 111 permits the seal support chamber to not rotate while the barrels 50 and 100 are rotating.

The seal support member 110 includes an elastomer seal 113 which is adapted to seal around the periphery of the shaft S as do seals 63 and 83. The seal support member 110 also includes seals to prevent the free passage of moisture between the barrel 50 and the seal support member 110. By providing the seal support member 110 with the bearing support 111, the rotational friction that would be caused by the seal 113 rotating against the shaft S is avoided thus significantly reducing the wear on the seal 113.

Above the elastomer seal 113, the barrel 50 includes a series of apertures 91 circumferentially spaced thereabout. The apertures 91 communicate with an annular space in the lower main sleeve 33 which in turn communicates with a vacuum port 92. Accordingly, the cleaning fluid is removed from the washing chamber W at its lower portion just above the elastomer seal 113. Thus, the washing chamber W is generally defined as being between the seals 63 and 113 and is preferably a closed and sealed chamber by means of suitable sealing means as is known in the seal art.

Figure 4:
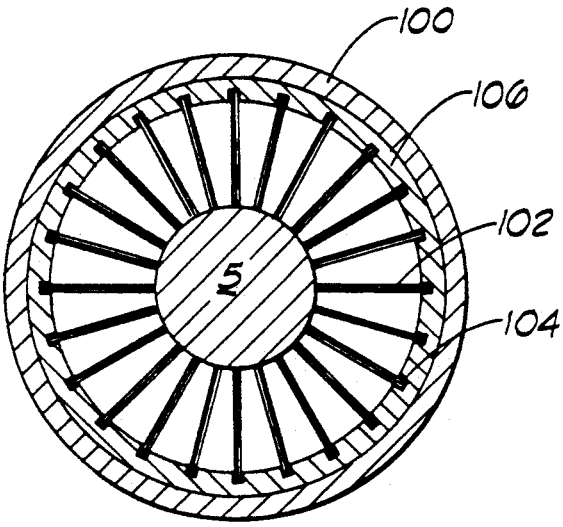
FIG. 4 is a cross sectional view of the shaft cleaning and decontamination apparatus taken along line 4—4 in FIG. 2.

The second barrel 100, like the first barrel 50, is preferably a generally cylindrical tube and has an internal diameter which is significantly larger than the outer diameter of the shaft S. The second barrel 100 also includes a series of radially inwardly directed brushes to scrub the exterior of the shaft S to provide an initial cleaning of the shaft S. This is the first stage of a three stage cleaning and decontamination process and is generally referred to as the dry scrub stage D. Preferably, the brushes are made of wire, such as stainless steel or other resilient material, so as to provide a rough scouring of the surface to remove even the most firmly attached debris. Referring to FIG. 4, the brushes 102 are preferably formed as vertical segments similar to the brushes 55 in the first barrel 50 and may be mounted in the same manner. As illustrated, the brushes 102 are modular and are adapted to slide into a vertical slots 104 in a mounting ring 106. The bottom of the second barrel 100 is open so as to allow the debris that is removed by the brushes 102 to fall to the ground. In operation, as will be explained below, a pan 108 (FIG. 5), such as a stainless steel pan, is placed adjacent the hole in the ground and below the apparatus 10 to collect the debris which falls from the wire brushes 102. Accordingly, these potentially contaminated materials can be collected and disposed in an environmentally sound manner.

Figure 5:
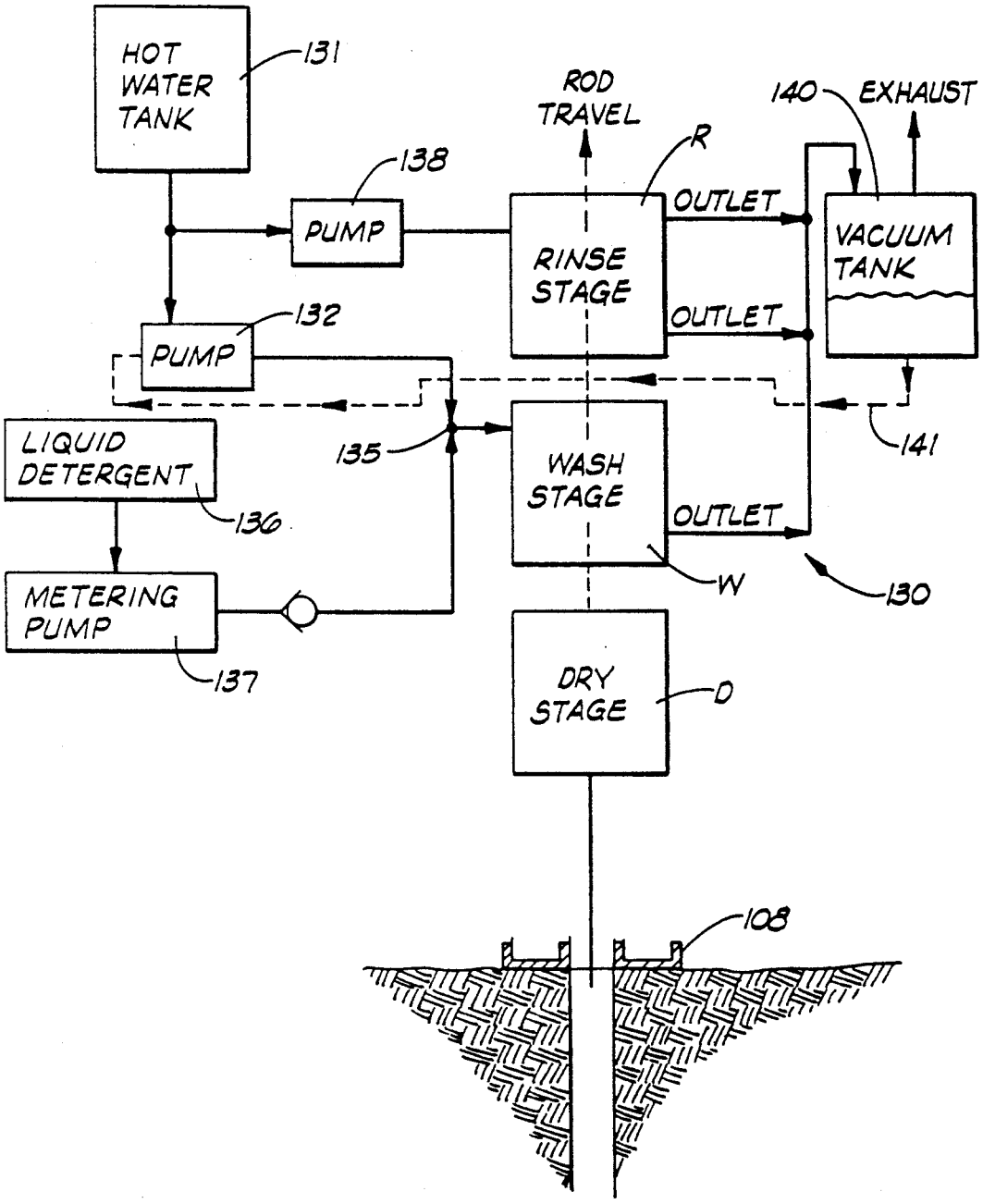
FIG. 5 is a schematic view of the shaft cleaning and decontamination system which includes the apparatus illustrated in FIG. 1.
Figure 5:
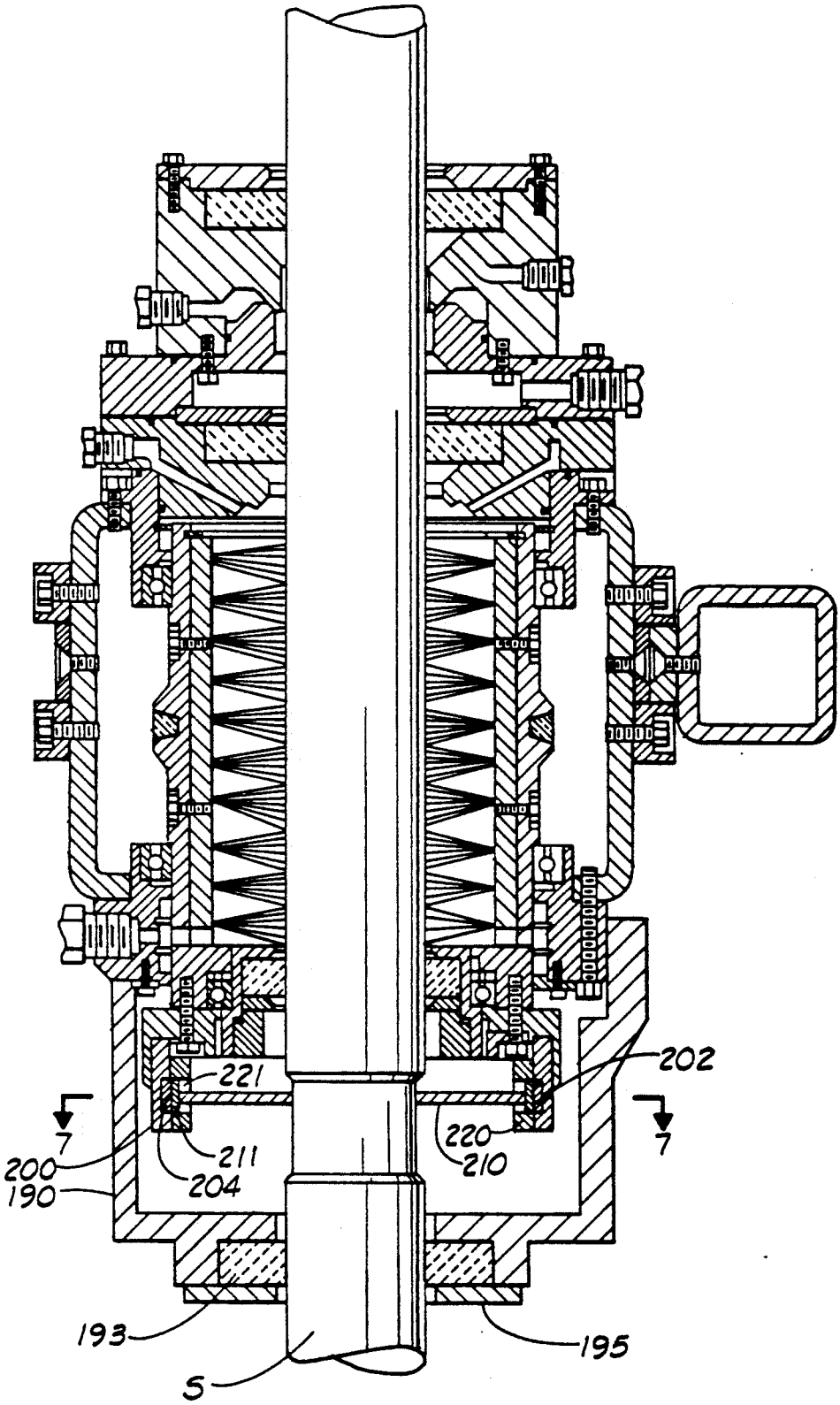

In operation, the apparatus 10 cleans and decontaminates the shaft S as it is removed from the ground. As illustrated in FIG. 1, the shaft S has soil, mud, sand or other debris, indicated generically as mud M, adhering to the surface thereof as it enters the lower end of the apparatus 10. The mud M is primarily cleaned off in the dry scrub stage D before the shaft S enters the hollow chamber inside the housing. Referring also to FIG. 5, the shaft S passes from the dry scrub stage D into the hollow interior space of the housing 30 and more particularly into the washing chamber W. The washing chamber W includes the scrub brushes 55 and cleaning fluid to thoroughly clean the exterior of the shaft S. As noted above, the cleaning fluid enters the upper portion of the washing chamber W and exits the lower portion which is opposite the direction the shaft travels through the chamber W. As such, the shaft S gets progressively cleaner while the cleaning fluid gets progressively dirtier. Moreover, the opposite direction of flow provides maximum utilization of the cleaning fluid by using the cleanest cleaning fluid to wash the cleanest part of the shaft and the dirtiest fluid to clean the dirtiest part to the shaft S. Further, the brushes 55 also reduce the amount of fluid necessary by agitating the fluid along the exterior surface of the shaft S enabling the fluid to dissolve or float as much dirt and contaminant as the fluid is capable of carrying under the circumstances. The shaft S then moves into the rinse chamber which also provides a counterflow of fluid to minimize the needed fluid or to maximize the utility of the fluid.

The system for washing and decontaminating the shaft S is illustrated in FIG. 5 and is indicated generally by the number 130. The system 130 comprises a hot water tank 131 for heating and providing hot water to the apparatus 10. The hot water from the tank 131 is pumped by a pump 132 to a mixing valve 135. Liquid detergent from a reservoir 136 is delivered to the mixing valve 135 by a metering pump 137 to mix with the hot water and form the cleaning fluid. In the preferred embodiment, the cleaning fluid is a hot water mixture although other suitable fluids and solvents may be used instead. Hot water from the hot water tank 131 is also provided by a pump 138 to the rinsing chamber R. Hot water is the preferred rinsing fluid since is inexpensive and generally quite effective. The system 130 further includes a vacuum tank 140 Which includes a vacuum pump (not shown) to maintain the tank 140 under a vacuum. The vacuum tank 140 is connected to each of the vacuum ports in the apparatus 10 so as to collect the fluid in the washing and rinsing chambers W and R. The vacuum tank 140 retains the fluid for subsequent disposal, however, in an alternative embodiment, the fluid may be reused in the washing chamber W. Conduit 141 indicated as a broken line connects the fluid reservoir in the bottom of the vacuum tank to an inlet for the pump 132. Accordingly the spent fluid may be recycled by being mixed with clean hot water. Another alternative arrangement (not shown) includes two vacuum tanks wherein one is connected to the rinsing chamber R and the other is connected to the washing chamber W. Each tank may be connected to a common vacuum pump, but the fluids from each are maintained separate. The fluid from the rinsing chamber R is then clean enough to use as a substantial portion as the cleaning fluid and may constitute the entirety of the cleaning fluid. As such, the water is put to its maximum use to conserve water and the water carrying capacity of the truck may be suitably reduced.

Figure 7:
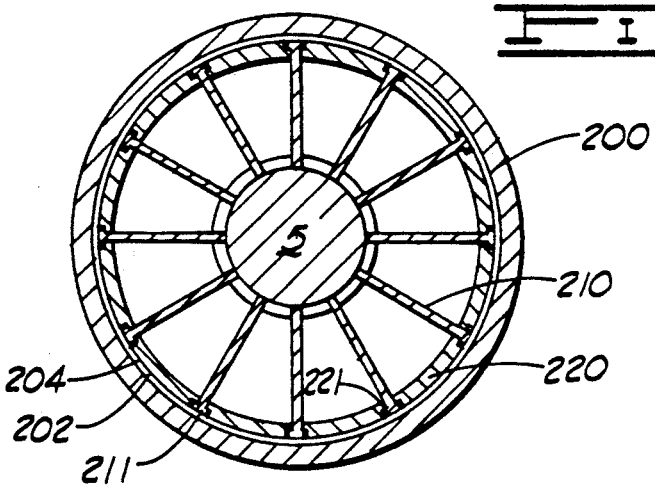
FIG. 7 is a cross sectional view of the alternative embodiment of the shaft cleaning and decontamination apparatus taken along line 7—7 in FIG. 6.

A second embodiment of the apparatus 10 has been developed which is essentially the same except with an improved dry scrub stage D. The second embodiment is illustrated in FIGS. 6 and 7 and the common elements in the first and second embodiments are indicated with the same numbers. The dry scrub stage D in the second embodiment comprises a second barrel 200 and a generally closed cover overlying the second barrel 200. The cover is attached to the lower main sleeve 33 and it does not rotate. An elastomer seal 193 is connected to the lower end of the cover 190 to seal the opening therein. A suitable seal cover 195 is connected to the cover to hold the seal 193 in place. The elastomer seal 193 is then provided so as to scrape the surface of the shaft S and remove any loosely adhering mud M. However, some of the rod strings used in cone penetrometer operations have portion of a reduced diameter which tend to carry mud and contamination into the washing chamber W which preferably should be removed by the dry scrub stage D. In the second embodiment, the elastomer seal 193 removes as much debris and mud M as possible and then the shaft S enters the dry scrub chamber D.

In the dry scrub chamber D, the second barrel 200 includes a number of rods 210 directed radially inwardly to the periphery of the shaft S. The rods 210 are relatively rigid and each comprises a long shaft with a circular head at one end generally similar in shape to a common nail. The rods 210 are mounted in a mounting ring 220 with a plurality of vertically extending slots 221 at the inner portions of the mounting ring 220. The width of the slots 221 is less than the diameter of the heads of the rods 210 but greater than the shafts of the rods. Radially aligned with each slot 220 is a circular bore hole 222 which has a larger diameter than the heads of the rods 210. Each rod 210 is inserted from the outside of the ring 220 through the bore hole 222 so that the shaft of the rod extends inwardly through the slot. Therefore, the shafts of the rods 210 are permitted to deflect up and down but are generally restricted from deflecting in other planes. The rods 210 are further provided with an elastomeric washer 211 to fill the void around the head thereof in the oversized bore hole 222 and provide a force on the rod 210 causing the rod to extend in a generally horizontal plane. The second barrel 200 is also provided with an annular slot 202 along the inner periphery so as to overlie the heads of the rods 210 when the ring is inserted into the second barrel 200. Within the annular slot 202 is positioned an elastomeric band 204 which also exerts a force on the head of the rods. When the ring 220 is mounted in the second barrel 200, the elastomeric band 204 in cooperation with the elastomeric washers 211 provide a force on the rods to maintain the rods in a generally horizontal plane. The rods 210 are dimensioned so as to reach into the recessed portion of the shaft S in the horizontal plane and deflect upwards or downwards when confronted with the full dimension of the shaft S. The rods 210 thereby loosen any remaining mud M on the exterior of the shaft S for easier cleaning in the Washing chamber W.

All the components of the system except for seals, gaskets, belts and the like are preferably formed of stainless steel. Other non-rusting material may also be used such as aluminum, etc.

The foregoing description of the preferred embodiments has related to cleaning and decontaminating shafts being extracted from the ground. It should be readily appreciated that the invention herein disclosed may be used for cleaning pipes and rods in substantially different embodiments. As such the specific terms used herein for describing the invention have only been used for purposes of illustration and not as limiting the invention. The scope and breadth of the invention should be ascertained by the following claims.

We claim:

1. A shaft cleaning apparatus for cleaning peripheral surfaces of an elongate shaft as the elongate shaft moves axially along a path of travel, said apparatus comprising:

a housing having a hollow interior space and openings at opposite ends thereof;

means defining a cleaning chamber within said hollow interior space;

means in said cleaning chamber for providing cleaning fluid to the peripheral surfaces of the shaft;

means in said cleaning chamber for scrubbing the wet peripheral surfaces of the shaft and comprising a brush for rotating generally about the path of travel of the shaft; and means for collecting the cleaning fluid from the surfaces, whereby the peripheral surfaces along the length of the shaft are cleaned as the shaft moves through said housing.

2. The shaft cleaning apparatus according to claim 1 further comprising means defining a rinse chamber in said hollow interior which includes means for providing clean rinse fluid to the surface of the shaft and means for removing the rinse fluid from the rinse chamber.

3. The shaft cleaning apparatus according to claim 1 wherein said cleaning chamber includes an inlet and an outlet for the shaft and wherein said apparatus further includes seal means at said inlet and said outlet to prevent moisture from escaping from said cleaning chamber along the shaft.

4. A shaft cleaning apparatus for cleaning peripheral surfaces of an elongate shaft as the elongate shaft moves axially along a path of travel, said apparatus comprising:

a housing having a hollow interior space and openings at opposite ends thereof;

means defining a cleaning chamber within said hollow interior space;

means in said cleaning chamber for providing cleaning fluid to the peripheral surfaces of the shaft;

means in said cleaning chamber for scrubbing the wet peripheral surfaces of the shaft and comprising a rotating barrel for rotating generally about the path of travel of the shaft;

means for collecting the cleaning fluid from the surfaces, whereby the peripheral surfaces along the length of the shaft are cleaned as the shaft moves through said housing; and a rotating barrel coaxially receiving the shaft and having a plurality of brushes directed generally radially inward for scrubbing the surface of the shaft prior to the shaft entering the cleaning chamber.

5. A shaft cleaning apparatus for cleaning peripheral surfaces of an elongate shaft as the elongate shaft moves axially along a path of travel, said apparatus comprising:

a housing having a hollow interior space and openings at opposite ends thereof;

means defining a cleaning chamber within said hollow interior space;

means in said cleaning chamber for providing cleaning fluid to the peripheral surfaces of the shaft;

means in said cleaning chamber for scrubbing the wet peripheral surfaces of the shaft and comprising a rotating barrel for rotating generally about the path of travel of the shaft; and means for collecting the cleaning fluid from the surfaces, whereby the peripheral surfaces along the length of the shaft are cleaned as the shaft moves through said housing; and a rotating barrel for coaxially receiving the shaft and having a plurality of stiff rods directed radially inwardly to scrape the surface of the shaft and remove debris therefrom prior to the shaft entering the cleaning chamber.

6. The shaft cleaning apparatus according to claim 5 further comprising a ring scraper sized slightly bigger in diameter than the shaft for scraping debris from the surface of the shaft prior to the shaft entering said barrel whereby said rods scrape remaining debris from the surface of the shaft such as may be lodged in recesses in the shaft.

7. A shaft cleaning apparatus for cleaning peripheral surfaces of an elongate shaft as the elongate shaft moves axially along a path of travel, said apparatus comprising:

a housing having a hollow interior space and openings at opposite ends thereof;

means defining a cleaning chamber within said hollow interior space;

means in said cleaning chamber for providing cleaning fluid to the peripheral surfaces of the shaft;

means in said cleaning chamber for scrubbing the wet peripheral surfaces of the shaft and comprising a rotating barrel for rotating generally about the path of travel of the shaft;

means for collecting the cleaning fluid from the surfaces, whereby the peripheral surfaces along the length of the shaft are cleaned as the shaft moves through said housing; and suction means for removing the cleaning fluid from the chamber.

8. A shaft cleaning apparatus for cleaning peripheral surfaces of an elongate shaft as the elongate shaft moves axially along a path of travel, said apparatus comprising:

a housing having a hollow interior space and openings at opposite ends thereof;

means defining a cleaning chamber within said hollow interior space;

means in said cleaning chamber for providing cleaning fluid to the peripheral surfaces of the shaft;

means in said cleaning chamber for scrubbing the wet peripheral surfaces of the shaft and comprising a rotating barrel for rotating generally about the path of travel of the shaft;

means for collecting the cleaning fluid from the surfaces, whereby the peripheral surfaces along the length of the shaft are cleaned as the shaft moves through said housing;

means defining a rinse chamber in said hollow interior which includes means for providing clean water to the surface of the shaft and means for removing the water from the rinse chamber; and means for recycling the rinse fluid as wash fluid to conserve the use of fluid.

9. A shaft cleaning apparatus and decontaminating system comprising:

a housing having a hollow interior space and openings at opposite ends thereof;

means defining a cleaning chamber within said hollow interior space;

means in said cleaning chamber for providing cleaning fluid to the peripheral surfaces of the shaft;

means in said cleaning chamber for scrubbing the wet peripheral surfaces of the shaft and comprising a rotating barrel for rotating generally about the path of travel of the shaft;

means for collecting the cleaning fluid from the surfaces, whereby the peripheral surfaces along the length of the shaft are cleaned as the shaft moves through said housing; and means for collecting the cleansing fluid for subsequent disposal.

10. A shaft cleaning apparatus for cleaning peripheral surfaces of an elongate shaft as the elongate shaft moves axially along a path of travel, said apparatus comprising:

a housing having a hollow interior space and openings at opposite ends thereof;

means defining a cleaning chamber within said hollow interior space;

means in said cleaning chamber for providing cleaning fluid to the peripheral surfaces of the shaft;

means in said cleaning chamber for scrubbing the wet peripheral surfaces of the shaft and comprising a rotating barrel for rotating generally about the path of travel of the shaft;

means for collecting the cleaning fluid from the surfaces, whereby the peripheral surfaces along the length of the shaft are cleaned as the shaft moves through said housing; and wherein at least part of said housing comprises a rotatable barrel and said means for scrubbing is attached to said barrel.

11. The shaft cleaning apparatus according to claim 10 wherein said cleaning chamber is defined within said rotatable barrel.

12. The shaft cleaning apparatus according to claim 11 wherein said cleaning chamber includes an inlet and an outlet and wherein said apparatus further includes seal means at said inlet and said outlet.

13. The shaft cleaning apparatus according to claim 12 further comprising a seal support member connected to the inside of said barrel by bearing means which allows said seal support member to rotate relative to said rotatable barrel; and wherein said seal means at said inlet is attached to said seal support member such that said seal means seals said cleaning chamber and said barrel may rotate without said seal means rotating with said barrel so as to reduce wear of said seal means.

14. The shaft cleaning apparatus according to claim 13 wherein said seal support member supports said seal means at said inlet of said cleaning chamber and said barrel further includes a portion extending from said cleaning chamber beyond said seal support member to define a dry scrub stage, and further comprising scrubbing means in said dry scrub stage for scrubbing the outer surface of the shaft prior to the shaft entering said cleaning chamber.

15. The apparatus according to claim 1 wherein said brush is mounted in a rotating barrel mounted to encircle the path of the shaft with said brush extending inwardly to the surface of the shaft.

16. The apparatus according to claim 9 wherein said brush is mounted in a rotating barrel mounted to encircle the path of the shaft with said brush extending inwardly to the surfaces of the shaft.

* * * * *